US010292539B2

(12) United States Patent
Schindler

(10) Patent No.: US 10,292,539 B2
(45) Date of Patent: May 21, 2019

(54) CARRIER BODY FOR SANITARY SURFACE MATERIAL

(71) Applicant: SWISSPAL AG, Baar (CH)

(72) Inventor: Martin Schindler, Munich (DE)

(73) Assignee: Martin Schindler, Munich (DE)

( * ) Notice: Subject to any disclaimer, the term of this patent is extended or adjusted under 35 U.S.C. 154(b) by 4 days.

(21) Appl. No.: 15/626,358

(22) Filed: Jun. 19, 2017

(65) Prior Publication Data

US 2017/0280943 A1 Oct. 5, 2017

Related U.S. Application Data

(62) Division of application No. 12/682,625, filed as application No. PCT/EP2008/008872 on Oct. 20, 2008, now Pat. No. 9,687,118.

(30) Foreign Application Priority Data

Oct. 19, 2007 (DE) ..... 2007 050 150

(51) Int. Cl.
*A47K 3/40* (2006.01)
*A47K 3/16* (2006.01)

(52) U.S. Cl.
CPC ..... *A47K 3/40* (2013.01); *A47K 3/1605* (2013.01)

(58) Field of Classification Search
CPC ..... A47K 3/40; A47K 3/281; E03F 5/0407
USPC ..... 4/695, 613, 612
See application file for complete search history.

(56) References Cited

U.S. PATENT DOCUMENTS 2,239,969 A 4/1941 Morthland
3,139,627 A 7/1964 Rice
3,606,617 A * 9/1971 Frazier ..... A47K 3/00 4/613
3,675,384 A 7/1972 Knecht
4,557,004 A 12/1985 Piana
5,845,347 A * 12/1998 Young ..... A47K 3/008 4/613
5,913,777 A 6/1999 Gerber
6,003,169 A * 12/1999 Davis, Jr. ..... A47K 3/40 4/584

(Continued)

FOREIGN PATENT DOCUMENTS

AT 6453 U1 11/2003
DE 202005002299 U1 5/2005

(Continued)

OTHER PUBLICATIONS

International Search Report issued in parent PCT/EP2008/008872, 6 pages.

*Primary Examiner* — Lauren A Crane
(74) *Attorney, Agent, or Firm* — Hooker & Habib, P.C.

(57) ABSTRACT

A carrier body assembly for forming part or all of a shower floor includes a rigid carrier body having a bearing surface for sanitary surface material such as tile and a sealing membrane that overlies the top or bottom surface of the carrier body but is attached to only a portion of the top or bottom surface. The unattached portion of the membrane is folded away from the carrier body to enable trimming of the carrier body to fit without damaging the membrane. After installation of the carrier body the membrane overlies the adjacent shower structure to form a watertight, water-impermeable connection between the carrier body and the adjacent shower structure.

24 Claims, 5 Drawing Sheets

(56) References Cited

U.S. PATENT DOCUMENTS

| | | | | |
|---|---|---|---|---|
| 7,642,542 | B2 | 1/2010 | Suzuki et al. | |
| 8,132,275 | B2 | 3/2012 | Wilson et al. | |
| 2003/0089059 | A1* | 5/2003 | Kirby | A47K 3/40 52/265 |
| 2005/0028270 | A1 | 2/2005 | Nehring | |
| 2007/0130685 | A1* | 6/2007 | Huang | A47K 3/40 4/613 |

FOREIGN PATENT DOCUMENTS

| | | | |
|---|---|---|---|
| DE | 202006012825 | U1 | 12/2006 |
| DE | 102006047437 | B3 | 7/2008 |

* cited by examiner

CARRIER BODY FOR SANITARY SURFACE MATERIAL

RELATED APPLICATIONS

This application claims priority from applicant's co-pending U.S. patent application Ser. No. 12/682,625 "Carrier Body for Sanitary Surface Material, Method of Adapting Such a Carrier Body to Floor Dimensions of a Sanitary Shower Facility, and Use of the Carrier Body" filed 20 Apr. 2010, which in turn is a US nationalization of now expired PCT Patent Application No. PCT/EP2008/008872 filed 20 Oct. 2008, which PCT application claims priority from German Patent Application DE 2007050150.3-16 filed 19 Oct. 2007, which priority applications are each incorporated by reference as if fully set forth herein.

FIELD OF THE DISCLOSURE

The disclosure relates to a carrier body for sanitary surface material such as tiles, acrylic coatings, or the like found in shower facilities.

BACKGROUND OF THE DISCLOSURE

Where shower facilities are involved, a carrier body is provided that is protected by a sanitary surface material such as tile or acrylic. The carrier body may be installed adjacent to a previously constructed floor or wall structure, and the surface material may extend to cover the adjacent floor or wall structure. The upper surface of the carrier body has a drain opening that connects to a drain for removal of waste water. It is desirable that installation of the carrier body and sanitary surface material, as well as the connection of the drain opening to the drain and the sealing of the carrier body with the adjacent floor or wall structure be carried out quickly and efficiently, and without leaks.

The carrier body during use of the shower supports the weight of the shower user and is therefore a rigid body that provides stable footing for the user and resists cracking or separation of the sanitary surface material.

Some carrier bodies are prefabricated for installation on site. Holzmann et al EP 1 388 317 A2 discloses a prefabricated carrier body formed as a support plate that includes a set of sealing strips attached to and extending along the upper periphery of the support plate. The sealing strips extend outwardly a short distance beyond the periphery of the support plate. The support plate is closely received in an opening formed in the adjacent floor structure and butts up against the adjacent floor structure. As a result, the sealing strips overlap the adjacent floor structure and thereby cover the butt joints. Tiling the adjacent floor surfaces covers the sealing strips and cooperates with the sealing strips to forms a water tight, water-impermeable connection between the carrier body and the adjacent floor structure.

In a similar manner, Illbruck Sanitaertechnik GmbH DE202006012825U1 discloses a prefabricated carrier body formed from rigid foam that includes sealing strips attached to the carrier body. Each sealing strip protrudes from a respective side face of the carrier body. The strips can be glued or otherwise sealingly attached to the adjacent floor or wall structure after installation of the carrier body in the appropriate sized opening.

Prefabricated carrier bodies delivered to installation sites that are carefully prepared to closely receive the carrier body generally present little or no problem in regard to sealing-off the carrier body in relation to its surroundings. But if the carrier body cannot fit, or does not closely fit, into the prepared adjacent floor or wall structure, difficulties can arise in the sealing of the carrier body with the sealing strips, as well as difficulties applying the sanitary surface material—in particular where tiles and limiting dimensions are concerned.

Rather than a prefabricated carrier body, it is also known to provide a premanufactured shower foundation that is directly installed onto the subfloor of a shower stall or alcove and forms the entire shower floor. Providing a prefabricated shower foundation eliminates the need for the services of a skilled craftsman in constructing a shower foundation on site, and a prefabricated shower foundation can be installed in one trip to the job site without the need to wait for adhesive or mortar set up.

A prefabricated shower foundation is disclosed in Young, U.S. Pat. No. 5,845,347. In Young, an injection molded base having a generally flat portion defining the area for the shower floor, an integral, solid vertical curb along one side of the flat portion, and vertical extensions along the other sides of the flat portion is formed from a synthetic resin. The base is intended to rest on the subfloor of the shower stall or alcove, and the curb and vertical extensions contain the water draining from the shower floor during use.

After formation of the base, a waterproof membrane is formed over the base, including the curb and vertical extensions (waterproof as used herein means water-impermeable). The membrane is preferably formed by spraying a liquid synthetic rubber onto the base and allowing the liquid rubber to dry. A continuous sheet of solid waterproof material could be used to form the waterproof membrane but folds or creases in the sheet necessary to conform the sheet to the base prematurely stress the sheet and damages the integrity of the sheet.

After the waterproof membrane is formed, backing material formed as a backer layer is placed over the flat portion of the base and underneath an upper drain portion secured to the base. The backer layer may be made of a plurality of sheets of cement backer boards such as those sold under the DUROCK™ or WONDERBOARD™ trademarks.

The backer layer in Young is not intended to be a waterproof layer or act as an additional waterproof sealing membrane that seals the waterproof membrane applied to the base from water received through the backer layer. As is known to persons of ordinary skill in the relevant shower construction art, cement backer boards are not waterproof, that is, not water impermeable to function as a seal. As explained in Young, the flat portion of the base has its own slope to accommodate the drainage of any water which may seep through the backer layer. The water drains down the base to weep holes in the drain.

Cement backer boards have sufficient flexibility to conform to the slope during installation without cracking. The backing layer after being installed against the base then cooperates with the base to form a rigid carrier body that is capable of providing stable footing for the user and resists cracking or separation of the sanitary surface material applied over the backing layer after the prefabricated shower foundation is installed on site.

Mortar is then applied between the outside edges of the drain portion and the protruding edges of the backer boards to ensure a continuous seal around the drain portion. To complete the prefabricated shower foundation, mortar or like material is molded over the vertical curb to provide additional strength and rigidity.

The prefabricated shower foundation is installed on site in the space designated for the shower stall or alcove. A waterproof plastic lining is attached to the wall studs and over the vertical extensions of the base, and wall panels are placed directly onto the backer layer and are attached to the studs. Sanitary surface material, such as a tile adhered by grout is secured directly to the backer layer and shower walls. Although as pointed out earlier that cement backer boards are not waterproof, the boards do not swell when wet. The structural integrity of the tile, grout, and the backer layer itself is maintained even if water is absorbed through the grout and into the backer layer.

Young discloses a prefabricated base with predetermined dimensions that defines the size of the shower floor, and forming a rigid carrier body sized to those predetermined dimensions.

Another type of prefabricated shower foundation is formed from a thermoplastic plastic sheet that forms a shell having a hollow backside. The shell includes a shower floor portion spaced from the backside, and raised side walls surrounding the floor for containing and directing water flow. The shell alone does not provide the rigidity required for supporting the weight of a user standing on the floor portion of the shell. The shell is filled with a backing material that supports the shell on the subfloor of the shower stall or alcove and cooperates with the shell to form a rigid carrier body capable of stably supporting the user.

Because the upper side of the shell is exposed to view and is itself water impermeable, the shell itself functions as a waterproof layer that covers the backing material.

An example of a prefabricated shell shower foundation is disclosed in Huang et al. US Patent Application Publication US2007/0130685 ("Huang"). As pointed out in Huang, the backing material adds considerable weight to the completed shower foundation. Huang discloses filling the plastic shell with a resinous material and low weight density fillers to reduce the weight of the finished prefabricated shell shower foundation while maintaining suitable structural rigidity.

Both Young and Huang disclose prefabricated shower foundations using a prefabricated plastic base and a backing material that cooperates with the base to form a rigid carrier. In Young, the plastic base supports the backing material while in Huang the backing material supports the plastic base. Young, by placing the backing material over the base, allows for tiled shower floor surfaces which many consumers prefer. Young also provides a redundant waterproof membrane over the plastic base before installing the backing material. In Huang, a redundant waterproof membrane could also be provided by spraying the membrane onto the inside of the plastic shell before adding the backing material.

Kirby US Patent Application Publication 2003/0089059 discloses a construction for a portion of a shower foundation that forms a shower curb. The shower curb is located adjacent to a shower pan and is constructed on site, relying on the presence of a shower liner previously placed to be under an adjacent shower pan construction in which a waterproof membrane formed as a shower liner is provided between the backing material and the sanitary surface material. The backing material is formed by stacking two or three two-by-four dimensional lumber boards in a vertical stack. The bottom surface of the bottom board rests against the subfloor of the shower stall or alcove.

A shower liner is placed over and covers the exposed side surfaces of the boards and the top surface of the top board. A three-sided lattice-like frame is placed over the sheet and the boards. The side of the frame extending along the inner side of the boards extends only partway down from the top surface of the top board. A cementitious material or "mud" is applied over the frame and into the lattice openings to provide a hard surface for laying ceramic tile over the hardened material. The boards support the weight of a user stepping on top of the shower curb's ceramic tile.

The shower liner is positioned below a sloped shower pan that is adjacent to the shower curb. When the shower liner is installed under the shower pan, a sufficient quantity is left over for overlying the boards. Excess shower liner would be trimmed at some point in the construction of the shower curb.

Kirby discloses that the shower curb can be constructed after the remainder of the shower foundation is installed on site and not necessarily constructed as part of a premanufactured shower foundation. The backing material is cut to fit on site, and then assembled after cutting with other components brought to the job site or previously installed in prior construction of the shower foundation.

The shower curb disclosed in Kirby is very similar to the shower curb disclosed in Young. Kirby, like Young, discloses a shower curb element (made of stacked lumber in Kirby, and molded plastic in Young) that rests on the subfloor and a flexible waterproof sheet that overlays and conforms to the shower curb element (although Young prefers a sprayed-on membrane). Kirby, like Young, discloses applying a moldable "mud" or mortar over the sheet overlying the shower curb element, allowing the mud or mortar to harden, and laying tile on the hardened surface. Kirby essentially differs from Young's shower curb only in disclosing a three-sided frame that assists in applying the mud. Kirby's frame could also be adapted for use applying mortar to Young's shower foundation.

Premanufactured carrier bodies with attached peripheral seals and premanufactured shower foundations are not practical for all construction situations. The shower dimensions may not be known, or not known with sufficient accuracy. The shower dimensions may not be compatible with available premanufactured carrier bodies or premanufactured shower foundations.

Thus there is a need for a carrier body assembly that is adaptable on-site for different shower dimensions and not limited to specific, predetermined shower dimensions as are the carrier bodies and shower foundations described above.

BRIEF SUMMARY OF THE DISCLOSURE

Disclosed is a carrier body assembly that is adaptable on-site for different shower dimensions and is not limited to a specific shower dimension.

This is achieved by a carrier body assembly that includes a rigid carrier body and a flexible, waterproof sealing membrane attached to and overlying a top or bottom side of the carrier body. A portion of the sealing membrane overlying the carrier body can be folded away from the carrier body to expose a portion of the carrier body without interference from the sealing membrane. The exposed portion of the carrier body is trimmed as required to conform to and properly fit the shower stall or alcove.

After trimming, the carrier body is placed in the shower stall or alcove. The sealing membrane is placed in overlapping relationship with the adjacent shower floor, shower wall, or shower curb structure and forms a water tight connection between the carrier body and adjacent shower structures.

In an embodiment of the disclosed carrier body assembly, part of the sealing membrane is firmly affixed onto the bearing surface, the bottom pan area, and the exposed inner surface of the drain opening.

Adhesion to flooring topping, or, to the edge surfaces of the carrier body is hereafter described. If necessity requires that the carrier body be trimmed to fit the shower space, then the dimensions of the carrier body can be adjusted by vertical cutting. Since only a part of the sealing membrane is applied firmly onto an first (inner) part of the carrier body, then the remaining part of the sealing membrane, which overlaps the edges of the carrier body in a temporarily loose state can be folded back to clear the area. Thereafter, the carrier body can be correctly cut to a conforming size in the second (outer) partial area (FIG. 1) without sealing membrane being placed thereupon.

Following the said cut-to-fit operation on the carrier body as required by dimensioning to meet the shower site, then the loose, outer area of the sealing membrane can be bound firmly to the residual section of the second (outer) partial area of the carrier body. This allows the so cut edges of the carrier body to be overlapped and establishes an advantage of creating a sealed binding about the periphery of the said carrier body.

Especially advantageously, it is possible that the disclosed carrier body assembly can find productive application in the development of a bottom pan for a projected, sanitary enclosure, such as a shower cabinet.

Particular advantage is taken to assure that the area of sealing membrane which, in possible embodiments of the disclosed carrier body assembly, is made larger than the surface of the carrier body to be overlaid. By this means, the carrier body can be installed even in such cases as occur in the described state of the present technology. In such cases it is not necessary that the carrier body be made to conform in its original factory-made dimensioning to the dimensions of the site of a shower enclosure. If such an event occurs, then those partial, outward areas of the sealing membrane, which first loosely overlap the carrier body, can be installed onto the corrected second (outer) surface of the carrier body in a simple manner at the construction site. The sealing membrane is so advantageously designed, that one side binds easily against the carrier body while the other, i.e., reverse side, is coated with adhesive. If necessary, the adhesive can be especially adapted for securing tiling.

It is also unnecessary in embodiments of the disclosed carrier body assembly that the sealing membrane be designed entirely as a flat surface. That is to say, the intention is to evenly overlap entirely the thereunder lying surface of the carrier body. Flatness is in order where the corresponding, edgewise partial area of the surface of the carrier body has been loosely overlapped. The purpose of this arrangement is that, in a case of specific conformity of the carrier body to the dimensioning of the shower enclosure, it then becomes possible that the custom-cut edges of the actual periphery are properly overlapped. At the same time, a continuous sealing between the carrier body and adjacent surfaces can be obtained.

In a particularly advantageous embodiment of the disclosed carrier body assembly, the sealing membrane is placed on the bearing surface of the carrier body. On the then remaining, freely accessible, upward extending surface of the sealing membrane, it is possible to lay tiles, flat stone sections and the like to bring about a finished placement about the shower enclosure. If a sanitary top surface material is to be placed over the carrier's bearing surface, then this can be a sanitary sealing membrane such as, for example, an acrylic layer to cover the underside of a shower enclosure bottom pan. In this way, the underside of carrier body can adapt itself to the existing dimensioning of the site of the shower installation and the sealing membrane can serve to protect adjacent, neighboring surfaces.

The drain opening in the carrier body must coincide with an existing drain in the flooring. Accordingly, the drain of the carrier body is to be sufficiently adjustable to exactly meet the centerline of draining connections. The sealing membrane covers the exposed, inner surface of the opening.

The carrier body, as aforesaid, can be brought into exact conformation with field dimensions during installation of the shower. Mounting and shower component alignments are aided if the drain pan bottom of the carrier body be provided with a field corrected rim periphery. To accomplish this correction, and thus ease the installation, in embodiments of the disclosed carrier body assembly the bearing surface of the carrier body has been provided with predetermined linear indentations. In this way, it is possible to make vertical cuts along the carrier body edge in the second (outer) area, guided by these indentations. By means of these guided cuttings, the premounting operation is considerably facilitated.

In a possible embodiment of the disclosed carrier body assembly, the sealing membrane is permanently bonded on first (inner) portion of the carrier body. In the remaining part of the carrier body surface, the sealing membrane loosely overlaps the carrier body surface on the second (outer) portion, which portion can now be custom cut to the dimensioning of the shower enclosure. A conforming fit can be made by means of cutting the carrier body vertically in the second (outer) portion, which, at this point of installation, is loosely overlapped by the said sealing membrane. Prior to the mentioned trimming by cutting, the loosely overlapping, sealing membrane is folded back to clear the second (outer) portion, which lies thereunder. Since the sealing membrane is now securely anchored adhesively against the first (inner) area, it becomes possible that the vertical cutting of the carrier body at the previously stated desired location can be carried out on the still remaining section of the second (outer) area portion. This need not disturb the loose sealing membrane, which is folded out of the way. In an especially advantageous manner, with a preliminary trimming, the sealing membrane can be so dimensioned, that it overlaps a rim-aligned area above the edges after the cutting is ended. In this way, trimming-to-fit time can be reduced. However, the trimming of the sealing membrane can also be carried out prior to, or after the involved edge surface has been firmly adhesively attached.

The disclosed carrier body assembly has a number of advantages. The carrier body can be trimmed to fit at the job site without removing the sealing membrane from the carrier body and without damaging the sealing membrane while maintaining the size of the sealing membrane. The carrier body could also be trimmed off-site if the required final shape of the carrier body is known in advance. Unlike Kirby, the sealing membrane is attached to the carrier body before installation and eliminates the need for installing the carrier body adjacent to an existing shower liner or sealing membrane. The sealing membrane can be attached to the carrier body under controlled conditions off site for better seal integrity and less risk of inadvertent cutting, folding, or creasing of the sealing membrane where it is attached to the carrier body.

Other objects and features of the disclosure will become apparent as the description proceeds, especially when taken in conjunction with the accompanying drawing sheets illustrating one or more illustrative embodiments.

DETAILED DESCRIPTION

The following is an explanation and a more detailed description of embodiments of the disclosed carrier body assembly, with the aid of the above Figures, in accord with surrounding construction and, where necessary, also providing the method of installation and operation of the disclosed carrier body assembly.

FIG. 1

Figure 1:
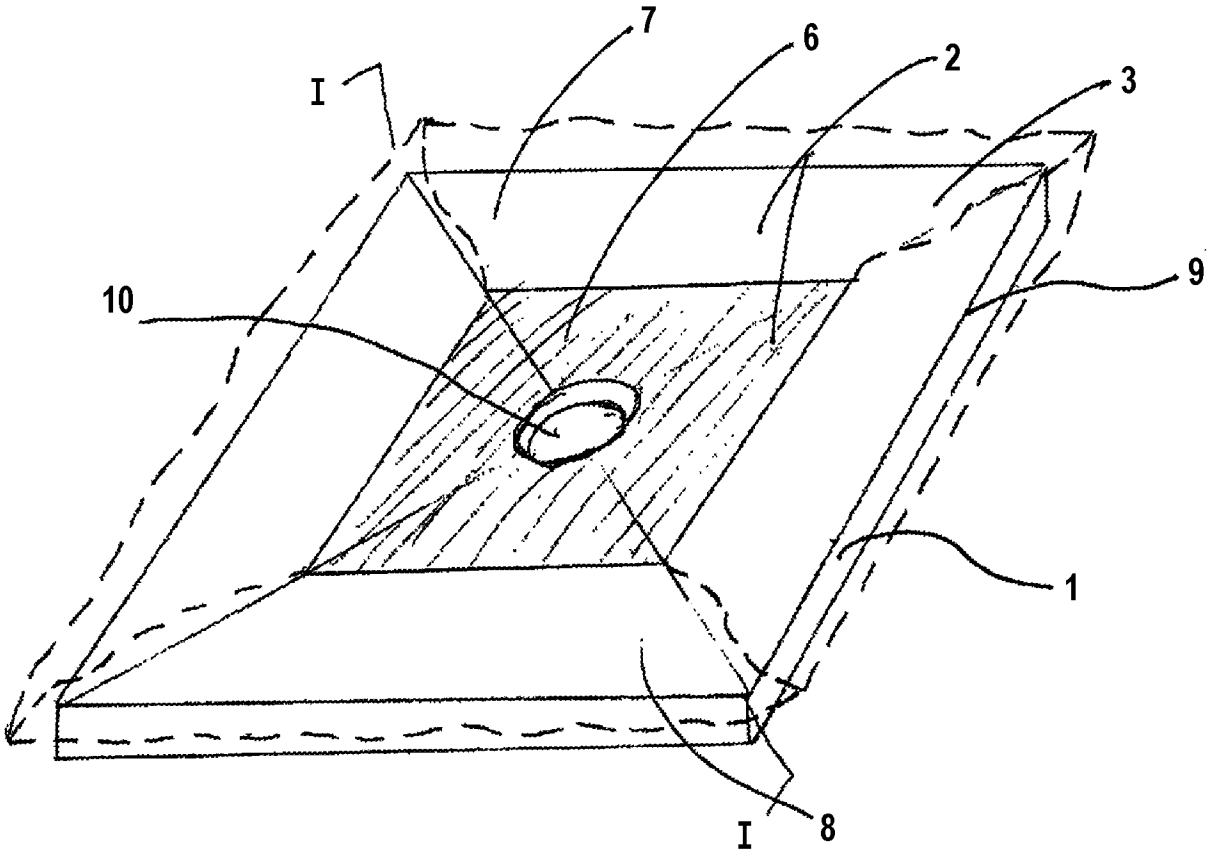
FIG. 1 is a perspective view of a carrier body assembly showing a sealing membrane covering the bearing surface of the carrier body.

In the perspective presentation of FIG. 1 of a first embodiment carrier body assembly, a carrier body 1 is depicted from an inclined view from above. In this view, the carrier body 1 possesses an upward exposed bearing surface 2, which is to be provided with a sanitary surfacing material 3. This surfacing material may be an acrylic coating or a tile covering or the like. In the perspective view of FIG. 1 the basic bearing surface 2 is designated as having within its borders an inner, centrally located "first" partial area 6. Correspondingly, the surface 2 also possesses a peripherally surrounding outer "second" partial area 7. The said first (inner) partial area 6 of the bearing surface 2 is that portion of the said bearing surface 2 of the carrier body 1 upon which a sealing membrane 8 of the carrier body assembly is adhesively affixed. This sealing membrane 8 is represented in FIG. 1 by dashed lines and extends outward away from the first (inner) partial area 6. The same sealing membrane 8, however, covers the second (outer) second partial area 7 of the bearing surface 2 in a temporarily loose, non-affixed manner. As the perspective presentation of FIG. 1 indicates, that the sealing membrane 8 thus overlaps the edges 9 at the periphery of the carrier body 1.

In this perspective presentation of FIG. 1, the bearing surface 2 is shown inclining itself downward from all directions toward a center point. At this center point of the carrier body 1 is provided an opening 10, which serves for connection to existing draining facilities in, presumably, a substrate and/or a supporting flooring.

In accord with an embodiment of the disclosed carrier body assembly it remains possible for the carrier body 1, as may be seen in the section of the second (outer) partial area 7, to be adjusted into alignment with the field dimensioning of the shower location. This adjustment could be carried out in some instances by means of a cut-to-fit operation. This advantageous adaption of size can be carried out on site by workmen with tools readily at hand, including, for example, a saw. Thus, in accord with this operation, a rapid and simple fitting of the outside dimensions of the carrier body 1 to the space requirements of the shower site is made possible at any time.

FIG. 2

Figure 2:
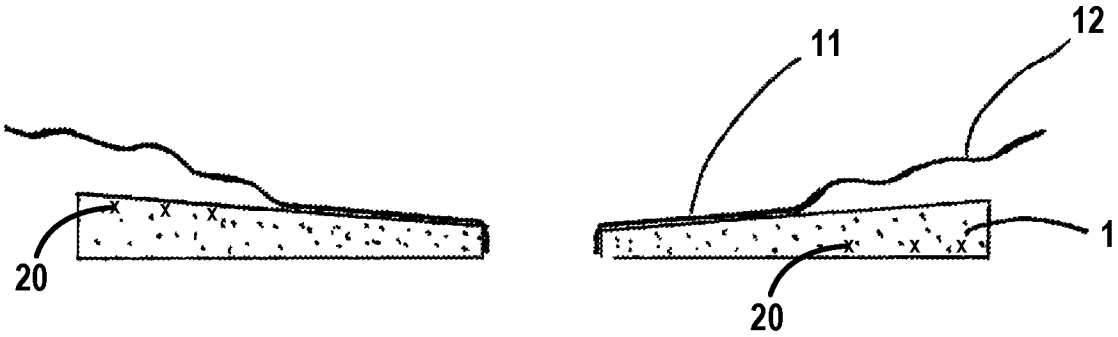
FIG. 2 is an enlarged sectional view along Sec. I-I of FIG. 1.

In FIG. 2, the FIG. 1 section along the line I-I of the carrier body 1 is shown in an enlarged scale. In FIG. 2, the first partial (inner) area 6 is made evident with a firmly attached part 11 of the sealing membrane 8. Likewise is exhibited the second partial (outer) area 7 with an overhanging, loose part 12 of the sealing membrane 8. As has already been mentioned, in the case of the through-cutting of the carrier body 1, first, the mentioned loose part 12 of the sealing membrane is folded back out of the way. Thereafter, the carrier body 1 is separated, i.e. cut, through the second (outer) area 7. When the cutting is finished, then the loose part 12 of the sealing membrane is again brought down onto the now trimmed section of the second (outer) partial area 7 and firmly attached thereto by adhesive means. When this is done, either before or after the cutting and adherent affixing, the loose part 12 of the sealing membrane 8 can be evenly trimmed. The result of this trimming allows the now cut-to-fit edge 13 (see FIG. 3*a*) of the second (outer) part of the carrier body 1 to be evenly overlapped by the sealing membrane 8.

The bearing surface 2 and/or the under surface 20 may possess predetermined linear indentations in order that a penetrative, vertical cutting can be carried out along the said indentations. The bearing surface 2 and/or the under surface 20 may possess the predetermined linear indentations. FIG. 2 illustrates such indentations 22 formed on the under surface 20 and the bearing surface 2 (each indention being shown representationally as an "x" in the drawing).

FIG. 3*a*

Figure 3A:
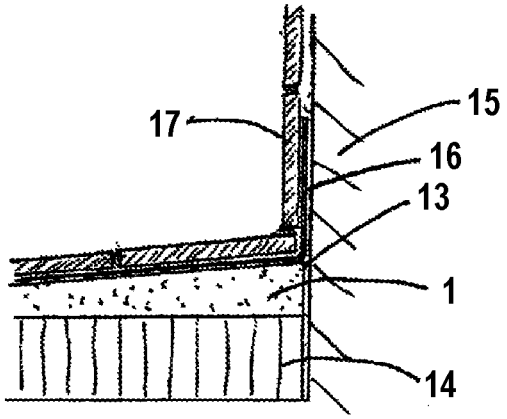
FIGS. 3*a* to 3*c* are the right side area of Sec. I-I of FIG. 2, which is cut through the carrier body and presents exemplary possibilities for mounting the carrier body adjacently to neighboring surfaces.

As the next step, the mounting of the carrier body 1 can now be executed and the said body fitted in alignment with the neighboring surfaces. In methods of operational possibilities, as set forth in FIGS. 3*a* to 3*c*, the carrier body 1 is shown as resting on a substrate 14 and its newly cut edge 13 abuts a wall 15. The sealing membrane residual portion 16, which remains after the cutting of the carrier body 1, is shown in FIG. 3*a* drawn upward (relative to this drawing) along the wall 15. This provides a seal between the wall 15 and the carrier body 1. Tiles 17 may now be laid against the wall 15 and the sealing membrane 16.

FIG. 3*b*

Figure 3B:
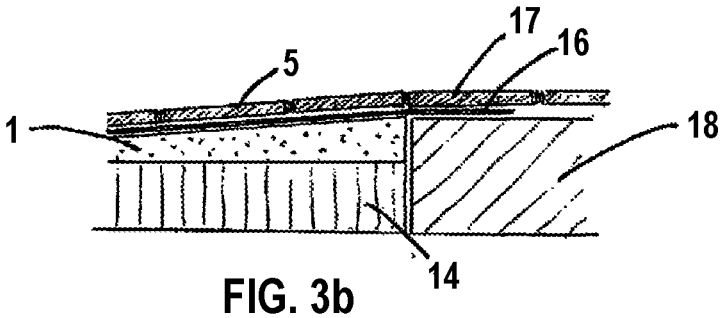

In the case of the example shown in FIG. 3*b*, the carrier body 1 is laid over a substrate 14 with a neighboring flooring 18 situated thereunder. In this case, the sealing membrane extension 16 is brought over the joint between the carrier body 1 and the flooring 18. Further, on the upper side of the flooring 18, an adhesive has been applied to unite the two. Likewise tiles 17 are laid against the flooring 18 with the sealing membrane edge 16 protruding from under the tile 5 of the carrier body 1 and intervening therebetween, thus overlapping the joint.

FIG. 3*c*

Figure 3C:
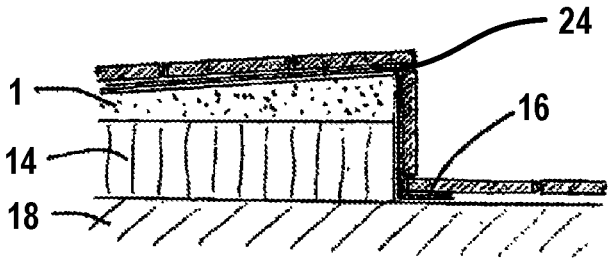

As a final possibility in this installation example, it remains to be shown in FIG. 3*c*, the manner in which the structure of the substrate 14, the carrier body 1, the thereon applied sealing membrane 8 and the tiles 5 are laid upon the said flooring 18. The continuing extension of the tiling 5 proceeds over the end surface of the carrier body 1, follows along the end edge of the substrate 14 and continues over the flooring 18. From this FIG. 3*c* can be inferred, that the sealing membrane section 16 is allowed to extend itself beyond the corner between the substrate 14 and the flooring 18. This extension of the sealing membrane section 16 provides an assuredly sufficient sealing. FIG. 3*c* also illustrates the outer membrane portion being folded along a fold line 24 by more than 90 degrees to conform to the shape of the carrier body 1

FIG. 4

Figure 4:
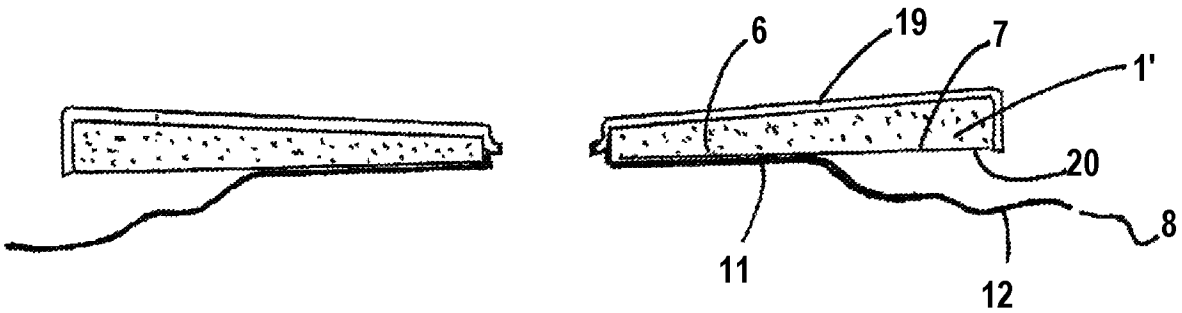
FIG. 4 is a view similar to FIG. 2 of a section through a second embodiment carrier body assembly wherein the sealing membrane has been affixed to the inner bottom side of the carrier body.

The arrangement of an alternate example of the carrier body 1' is presented in the section shown in FIG. 4. This invented version of the carrier body 1' represents principally the same construction as that of carrier body 1 of FIG. 1. Accordingly, FIG. 4 displays a similar cross section through the carrier body 1' as has been done in FIG. 2. However, in this case, the carrier body 1' of the FIG. 4 differentiates itself from the previous version, in that on its top exposed bearing side 2, it has been protected with a preinstalled acrylic covering material 19. This acrylic covering 19 extends itself, in the FIG. 4, along the carrier body 1' at least to partially over the peripheral edge thereof. It may be inferred from FIG. 4, that the sealing membrane 8, in this case, has been applied against the undermost, i.e. the bottom, surface 20 of the carrier body 1'. In correspondence to the invented constructive example shown in the FIGS. 1 and 2, this said bottom surface is likewise in a first (inner) partial area 6, where the sealing element 8 has been adhesively firmly affixed. Likewise, a second and loose segment of the sealing element 8 extends itself freely in proximity to the second (outer) partial area 7 of the carrier body 11.

The cutting to desired dimensioning of the carrier body 1', where FIG. 4 is concerned, is done in the same manner as described previously in regard to FIG. 2. Again in this case, it is of the essence, that upon the cutting through of the carrier body 1 in the second (outer) partial area 7, the loose part 7 of the sealing membrane 8 remain in an uncut state. By means of the inventive carrier body 1', it becomes possible, that the shower location can be specifically defined, with consideration being given to specific dimensioning and that the erection and sealing of the same can be carried out without difficulty.

FIGS. 5*a* to 5*g*

In the FIGS. 5*a* to 5*g* are to be found, once again, clearly exemplary possibilities for the placement of the carrier body 1' against the neighboring and adjacent objects and surfaces, such as walls 15, flooring 18 and the like. Principally in 5*b*, the determination has been made, that a cut-to-fit carrier body 1' is involved, which is supported on a substrate 14 and is then sealed off against a wall 15 with the aid of the sealing membrane extension 16. Even in this case, corresponding to the construction example of FIG. 3*a*, the contact area between the sealing membrane residual part 16 and the wall 15 is provided with a tile 17 installation.

Figure 5A:
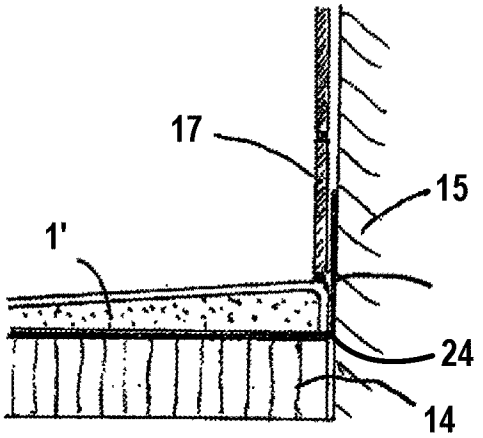
FIGS. 5*a* to 5*g* are the right side area of the section shown in FIG. 4, presenting exemplary possibilities for the mounting of the disclosed carrier body assembly onto neighboring surfaces.

The arrangements shown in FIG. 5*a*, as well as in FIGS. 5*c* to 5*g*, demonstrate, for instance, a carrier body 1', which is not cut, so that the acryl covering 19 thereof, remains untouched. FIG. 5*a* illustrates the outer membrane portion 16 folded along a fold line 24 by 90 degrees.

Figure 5B:
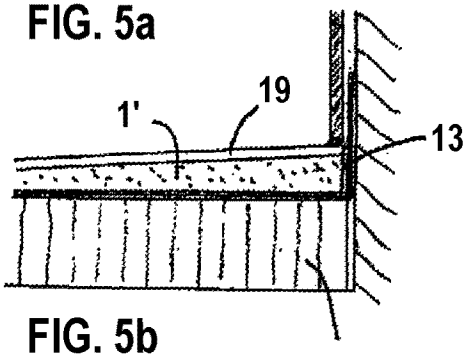
Figure 5C:
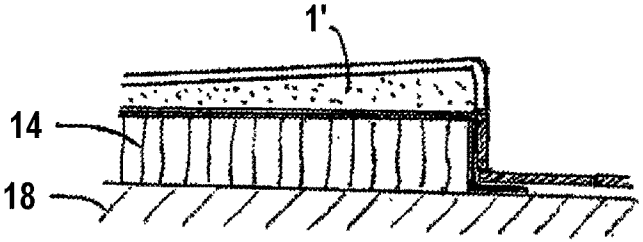
Figure 5D:
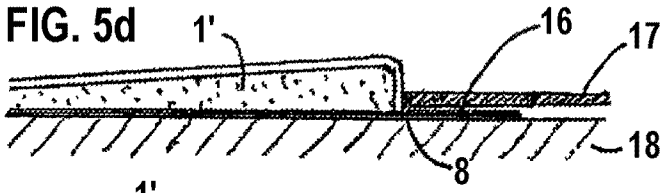
Figure 5E:
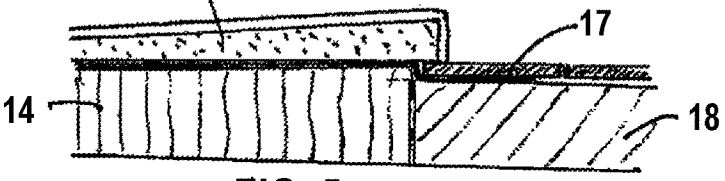

In FIG. 5*a* is shown an arrangement of the carrier body 1', wherein, in accord with the cut carrier body 1' described in FIG. 5*b*. In this FIG. 5*b* is shown the carrier body 1' supported on its substrate 14 and this arrangement is then supported on a flooring 18. Such an arrangement is also shown in FIG. 3*c*. In FIG. 5*d* the carrier body 1' is found, for example, with the sealing membrane 8 extended thereunder and accordingly lying between the carrier body 1' and the flooring 18. Also in FIG. 5*d* is to be seen, how the said sealing membrane extension 16 is brought further over the flooring 18, away from the shower site. Made evident also, is that the flooring 18 is sealed off against the carrier body 1', so that the tiling 17 can be laid in an orderly manner onto the sealing membrane section 16 and the flooring 18. In the example depicted in FIG. 5*e*, the substrate 14 with the thereupon laid carrier body 1' is provided to be somewhat higher in elevation than the adjacent flooring 18. Consequently the tiling 17 can be slipped in therebelow. Again in this case, a sealing is effected at the given points of impact by means of the sealing membrane section 16. Counter to this, in FIG. 5*f*, a situation is demonstrated, wherein the substrate 14 is lower than the level of the flooring 18.

Figure 5F:
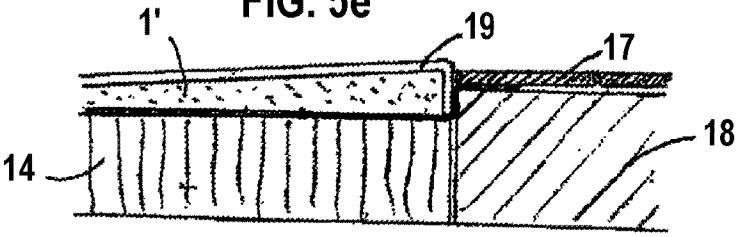
Figure 5G:
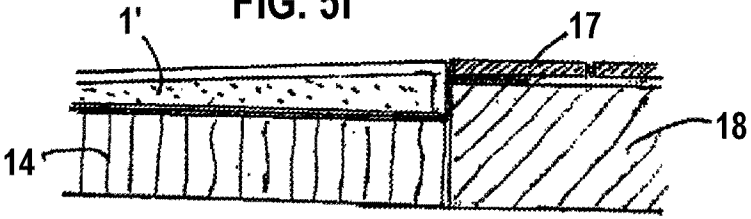

In the case of FIG. 5*f*, upon the laying of the tile on the flooring 18, a small difference in elevation marks the joint between the acrylic covering of the carrier body 1' and the subsequent area of tile 17. FIG. 5*g* makes further adjustment, wherein the combination of the carrier body 1' and the substrate 14 is so aligned with the flooring 18 and its tile 17 covering, that a smooth extension to the bottom is achieved. In both FIGS. 5*f* and 5*g*, as can be seen, in actual installation, the sealing membrane extension 16 is folded away, thus projecting over the flooring 18.

While one or more embodiments have been disclosed and described in detail, it is understood that this is capable of modification and that the scope of the disclosure is not limited to the precise details set forth but includes modifications obvious to a person of ordinary skill in possession of this disclosure, including (but not limited to) changes in material selection, size, operating ranges, environment of use, and also such changes and alterations as fall within the purview of the following claims.

What is claimed is:

1. A carrier body assembly for supporting a sanitary surface material, the carrier body assembly comprising:

a rigid carrier body and a sealing membrane, the carrier body and the sealing membrane being transportable as a unit;

the carrier body comprising an upper surface, a lower surface, and a drain opening extending through the carrier body from the upper surface to the lower surface;

one of the said upper and lower surfaces comprising an inner surface portion, an outer surface portion surrounding the inner surface portion, and a peripheral edge defining the outer perimeter of the said one surface, the drain opening disposed in the inner surface portion of the said one surface; and the sealing membrane comprising an inner portion and a flexible pliant outer portion surrounding the inner portion, the inner portion being disposed on an outer side of the carrier body assembly and the outer portion having an exposed outer edge surrounding the outer portion, the inner portion permanently affixed to and covering said inner surface portion of the one surface of the carrier body, at least a portion of the outer portion of the sealing membrane not permanently affixed to the carrier body and foldable away from the carrier body along a non-predetermined fold line to and from a substantially flat condition along the fold line 90 degrees or more while maintaining the integrity of the sealing membrane, the outer portion overlappable with the outer surface portion of the one surface of the carrier body and extendable from said peripheral edge of the one surface beyond said peripheral edge and away from the other of the said upper and lower surfaces of the carrier body, whereby the carrier body assembly may be transported from a remote location to a job site and at least a portion of the outer portion of the sealing membrane can be folded away from the carrier body at the job site to enable trimming of the carrier body without damaging the sealing membrane and can be folded towards the carrier body to overlap and extend beyond the carrier body after trimming.

2. The carrier body assembly of claim 1 wherein the inner portion of the sealing membrane is affixed to the said inner surface portion of the one surface of the carrier body by an adhesive.

3. The carrier body assembly of claim 1 wherein at least a portion of the upper surface or the lower surface of the carrier body slopes towards the drain opening.

4. The carrier body assembly of claim 1 wherein the carrier body comprises an outer peripheral surface extending from the upper surface to the lower surface and a layer of sanitary surface material that covers at least a portion of the outer peripheral surface.

5. The carrier body assembly of claim 4 wherein the layer of sanitary surface material covers the entire outer peripheral surface of the carrier body.

6. The carrier body assembly of claim 4 wherein the sanitary surface material comprises an acrylic material.

7. The carrier body assembly of claim 1 wherein the drain opening comprises a wall formed in the body, the inner portion of the sealing membrane covering at least a portion of the wall.

8. The carrier body assembly of claim 1 wherein the sealing membrane is attached to the lower surface of the carrier body and at least a portion of the upper surface of the carrier body slopes towards the drain opening.

9. The carrier body assembly of claim 1 wherein at least a section of the sealing membrane slopes towards the drain opening.

10. The carrier body assembly of claim 1 wherein the body comprises predetermined linear indentations on either the upper surface or the lower surface of the carrier body.

11. The carrier body assembly of claim 10 wherein the outer portion of the sealing membrane is overlayable over the indentations whereby the sealing membrane can be folded away from the indentations to expose the indentations to assist in trimming the carrier body for installation.

12. The carrier body assembly of claim 1 wherein the carrier body comprises an outer periphery and the sealing membrane is extendable beyond the entire outer periphery of the carrier body whereby the sealing membrane when extending beyond the entire carrier body extends from the entire periphery of the carrier body.

13. The carrier body assembly of claim 1 wherein the entire outer portion of the sealing membrane is not fixedly attached to the carrier body.

14. A transportable carrier body assembly for use in forming a shower foundation at a job site, the carrier body assembly comprising:

a rigid carrier body and a sealing membrane attached to the carrier body, the carrier body and the sealing membrane being transportable as a unit;

the carrier body comprising opposite first and second surfaces on opposite sides of the carrier body, a drain opening extending through the carrier body from the first surface to the second surface, the first surface comprising an outer peripheral edge that surrounds the first surface;

the first surface comprising an inner surface portion and an outer surface portion surrounding the inner surface portion, the outer surface portion extending from the inner surface portion to the outer peripheral edge; and the sealing membrane comprising an inner membrane portion and an outer membrane portion surrounding the inner membrane portion, the inner membrane portion being disposed on an outer side of the carrier body assembly, the inner membrane portion covering and permanently fixed to the inner surface portion, the outer membrane portion extendable from the peripheral edge of the first surface outwardly beyond the peripheral edge and away from the second surface, and the outer membrane portion overlappable with the outer surface portion to cover the outer surface portion, at least a portion of the outer portion of the sealing membrane being foldable away from the carrier body at least 90 degrees while maintaining the integrity of the sealing membrane, whereby the carrier body assembly may be transported from a remote location to the job site and at least a portion of the outer membrane portion can be folded away from the outer surface portion at the job site to enable trimming of the outer surface portion without damaging the sealing membrane.

15. The carrier body assembly of claim 14 wherein at least a portion of the first surface slopes towards the drain opening or at least a portion of the second surface slopes towards the drain opening.

16. The carrier body assembly of claim 14 wherein the inner portion of the sealing membrane is attached by an adhesive to the inner surface portion.

17. The carrier body assembly of claim 14 wherein the carrier body comprises a sanitary surface material disposed on the outside of the carrier body.

18. The carrier body assembly of claim 17 wherein the sanitary surface material comprises an acrylic material.

19. The carrier body assembly of claim 14 wherein the drain opening comprises a wall, the sealing membrane covering at least a portion of the wall.

20. The carrier body assembly of claim 14 wherein the carrier body comprises predetermined linear indentations on one or both of the first and second surfaces.

21. The carrier body assembly of claim 20 wherein at least one indentation of the said predetermined linear indentations is disposed on the outer surface portion.

22. The carrier body assembly of claim 14 wherein the outer membrane portion is extendable beyond the entire outer periphery of the first surface.

23. The carrier body assembly of claim 14 wherein the sealing membrane extends into the drain opening.

24. The carrier body assembly of claim 14 wherein the entire outer portion of the sealing membrane is not fixedly attached to the carrier body.

* * * * *